US006790143B2

(12) United States Patent
Crumby

(10) Patent No.: US 6,790,143 B2
(45) Date of Patent: Sep. 14, 2004

(54) GAMING SYSTEM WITH INDIVIDUALIZED CENTRALLY GENERATED RANDOM NUMBER GENERATOR SEEDS

(75) Inventor: Hardy Lee Crumby, Fernley, NV (US)

(73) Assignee: IGT, Reno, NV (US)

( * ) Notice: Subject to any disclaimer, the term of this patent is extended or adjusted under 35 U.S.C. 154(b) by 0 days.

(21) Appl. No.: 10/372,902

(22) Filed: Feb. 24, 2003

(65) Prior Publication Data

US 2003/0130029 A1 Jul. 10, 2003

Related U.S. Application Data

(62) Division of application No. 09/519,947, filed on Mar. 7, 2000, now Pat. No. 6,533,664.

(51) Int. Cl.[7] ..... A63F 9/24
(52) U.S. Cl. ..... 463/42; 463/22
(58) Field of Search ..... 163/1, 9–13, 16–20, 163/22, 25–26, 29, 40–42; 700/91–93; 273/138.1, 139, 138.2, 269, 143 R, 292–293; 379/93.13

(56) References Cited

U.S. PATENT DOCUMENTS 4,652,998 A 3/1987 Koza et al.
5,324,035 A 6/1994 Morris et al.
5,779,545 A 7/1998 Berg et al.
6,220,961 B1 4/2001 Keane et al.
6,419,583 B1 7/2002 Crumby et al.

*Primary Examiner*—Mark Sager
(74) *Attorney, Agent, or Firm*—George H. Gerstman; Seyfarth Shaw LLP

(57) ABSTRACT

A gaming system is provided in which a plurality of gaming terminals have gaming outcomes that are provided in response to a game outcome seed sent, to the gaming terminals, from a central computer. The game outcome seeds are individualized in the sense that not all gaming terminals in the system use the same seed at the same time. Preferably, seeds are addressed to individual gaming terminals or groups of terminals. Seeds may be transmitted to terminals in response to seed requests output by terminals. In one approach, seeds are generated as needed and/or substantially continuously. In another approach, batches, pools or lists of seeds are generated and a seed request is responded to by drawing a seed from a pre-defined list, until the list is depleted, whereupon a new list or batch is generated. In one approach, one or more lists are generated for each type of game or pay table. Preferably game outcome seeds are associated with tags or other information which can be used for verifying game outcomes and/or avoiding errors or cheating.

21 Claims, 6 Drawing Sheets

GAMING SYSTEM WITH INDIVIDUALIZED CENTRALLY GENERATED RANDOM NUMBER GENERATOR SEEDS

Cross reference is made to U.S. patent application Ser. No. 08/711,847, now U.S. Pat. No. 5,779,545 incorporated herein by reference. This application is a division of Ser. No. 09/519,947, filed Mar. 7, 2000 now U.S. Pat. No. 6,533,664.

BACKGROUND INFORMATION

In multi-terminal gaming systems, there can be a number of advantages to providing for centralized production or control of the numbers, signals, or other features which are used for determining game outcome at individual terminals. Central production or control can assist a casino or other entity in maintaining proper records, controlling gaming, reducing and preventing cheating or electronic or other errors, reducing or eliminating win-loss volatility and the like. In some jurisdictions, central production or control of outcome-determining signals or information is required, in at least some gaming systems, by regulatory authorities.

There are various manners in which outcomes can be centrally produced or controlled. According to one approach, the actual game outcome, as ultimately displayed to the customer (such as reel stops in the case of slot machines or simulated slot machines, cards dealt or drawn in the case of simulated card games and the like) are sent from a central location to individual gaming terminals. In at least some circumstances, this approach may present certain disadvantageous aspects including, for example, a relatively high bandwidth that may be required for transmitting game outcomes in real time, and lack of provisions for verifying results (e.g. to prevent or detect errors or cheating). In another approach, a central system outputs, at frequent intervals, a random number seed which all of the coupled gaming terminals can use for generating random numbers to be used in determining game outcomes. While this approach has a potential for providing numerous benefits to a gaming system, it would be further advantageous to provide a system in which random number seeds or other game outcome-determining number or signals could be individualized to gaming terminals, i.e. such that different gaming terminals in the system will receive different random number seeds and/or such that different terminals will be using different random number seeds at the same time. In one embodiment, providing individual random number seeds makes it generally feasible to implement a non-banked game, preferably a game in which individual game results are, in effect, substantially randomly selected from a predetermined pool of game outcomes. Furthermore, providing individual (preferably deterministic) random number seeds (e.g. by addressing output seeds to individual gaming terminals) facilitates monitoring of gaming procedures, and detection and prevention of errors and cheating. Accordingly, it would be useful to provide a system of gaming terminals in which game-determining random number seeds or other game determining numbers, signals and the like are centrally produced but are individualized so that each output random number seed (or similar number or signal) is sent to a different one (or group) of the gaming terminals in the system. Preferably addressing is performed such that a record is (at least temporarily) stored indicating which terminal was the addressee for which random number seeds.

In at least some contexts, it would be further advantageous to provide a system in which some of the gaming terminals are configured for playing games different from those of other terminals and/or are configured for playing at least two different games, either as selected by the player or as established by the casino or other game operator. For example, some terminals may be configured as slot machine-type games while others may be configured as poker-type games. Some gaming terminals may be configured to simulate three-reel slot machines while others may be configured to simulate five-reel slot machines. Accordingly, it would be advantageous to accommodate these type of gaming environments while still achieving benefits of a centrally-generated and individualized random number feature.

SUMMARY OF THE INVENTION

The present invention includes a recognition of the existence, source and/or nature of problems found in previous approaches, including as described herein. In one aspect, the present invention provides a gaming system which has a plurality of individual gaming terminals coupled, by one or more communication links, to a central computing system. The central computing system may be a single central computer or may have a plurality of computers coupled together. The central computer includes a facility for generating random number seeds. Preferably the seeds are deterministic in the sense that, for any given seed, it is possible to determine what game outcome will result from such a seed (for a particular type of game). Although it is possible to provide a system in which random number seeds are generated in an ongoing manner such as in a substantially continuous fashion and/or in response to received seed requests (received, e.g. from gaming terminals) in at least one embodiment random number seeds are generated in batches or pools, preferably in a fashion such that there are (at least approximately) a predetermined number of winning random number seeds (i.e. seeds which, when used by a gaming terminal to generate a gaming output will result in an outcome associated with a prize) in each pool with the seeds being sent to individual gaming terminals (or, in some embodiments, small groups of terminals) preferably in a randomly selected fashion.

In one embodiment, each random number seed (as it is randomly selected from the group or pool, in response to a request from a gaming terminal) is addressed to the gaming terminal which issued the request and electronically delivered to the requesting gaming terminal.

In one embodiment, gaming results are verified by sending additional information (i.e. in addition to the random number seed) for at least some such transmissions. For example, in one embodiment, information indicative of the particular gaming output which is to be (deterministicly) generated by the random number seed is sent along with the random number seed, at least for some game results. For example, additional information can be sent with random number seeds which are associated with prizes or which are associated with certain prizes, such as randomly selected prizes and/or particularly large prizes. The gaming terminal can then compare the actual game output (generated in response to the random number seed) with the transmitted (expected) gaming output (which the central system indicates should be the result of the random number seed). If the gaming terminal determines that its calculated outcome does not match the centrally-provided and transmitted outcome, then the gaming terminal will declare an error condition, will suspend game play and will output a message or alert to maintenance personnel of the error condition. By sending such additional information for only some outcomes it is possible to provide for validation or verification of game outcomes without requiring the bandwidth needed for always sending all reel stop or other game outcome indications for every game play (which generally has a relatively high bandwidth requirement compared to, for example, sending only a random number seed).

In one aspect, a central computer or computers outputs random numbers or other game output seeds or determiners to each individual gaming terminal. Preferably the central computer sequentially outputs numerous game outcome seeds, outputting one seed upon request from any individual gaming terminal, preferably with each random number seed being specifically addressed to the individual requesting gaming terminal. In one aspect, the game outcome seeds may be selected (or "drawn") by the central computer from a pre-developed, and preferably pre-randomized, list of seeds. Such selection results in the removal of those seeds from the list or pool, until the list is exhausted.

In one aspect a gaming system is provided in which a plurality of gaming terminals have gaming outcomes that are provided in response to a game outcome seed sent, to the gaming terminals, from a central computer. The game outcome seeds are individualized in the sense that not all gaming terminals in the system use the same seed at the same time. Preferably, seeds are addressed to individual gaming terminals or groups of terminals. Seeds may be transmitted to terminals in response to seed requests output by terminals. In one approach, seeds are generated are needed and/or substantially continuously. In another approach, batches, pools or lists of seeds are generated and a seed request is responded to by drawing a seed from a pre-defined list, until the list is depleted, whereupon a new list or batch is generated. In one approach, one or more lists are generated for each type of game or pay table. Preferably game outcome seeds are associated with tags or other information which can be used for verifying game outcomes and/or avoiding errors or cheating.

DETAILED DESCRIPTION OF THE PREFERRED EMBODIMENTS

Figure 1:
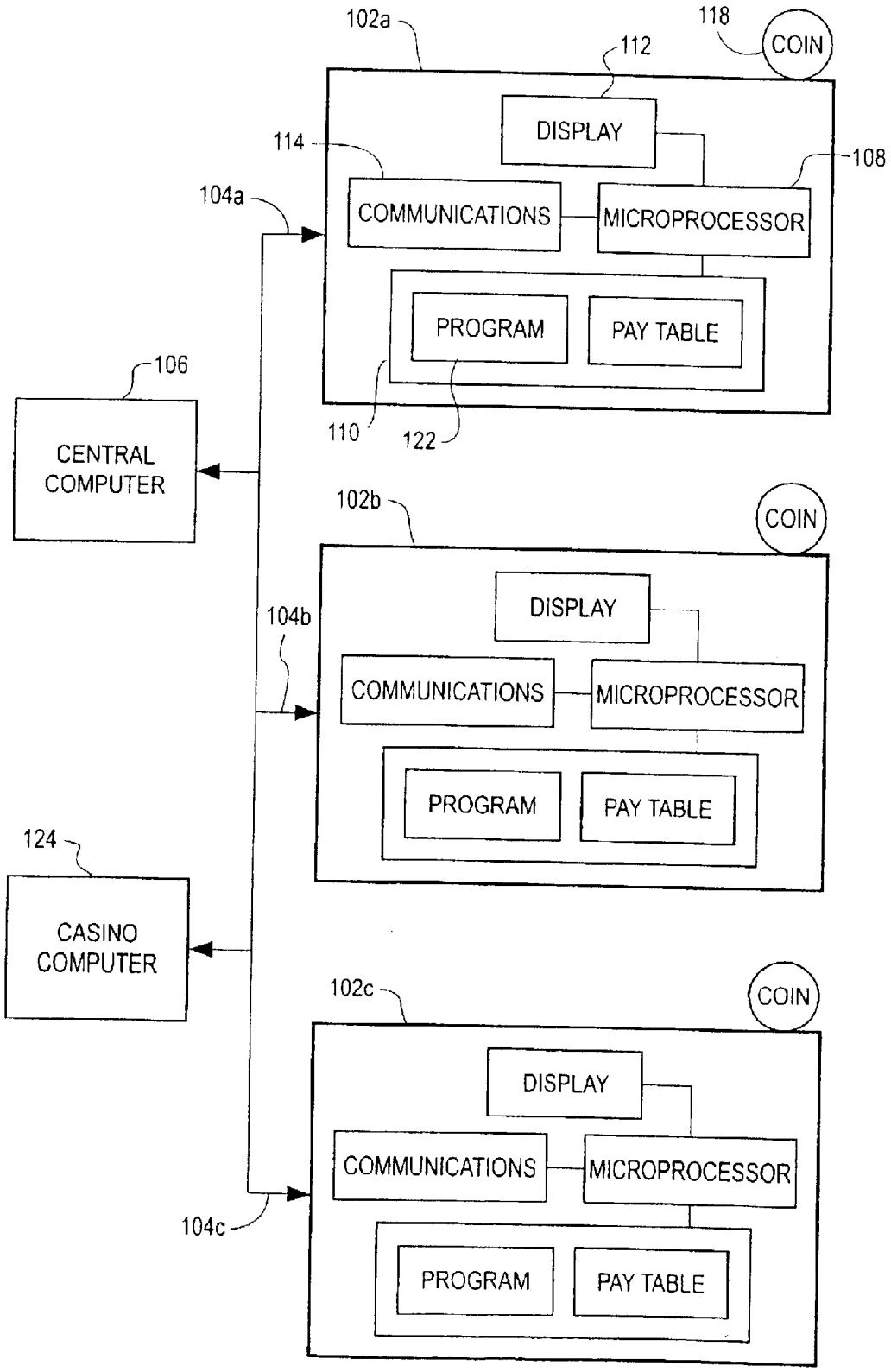
FIG. 1 is a block diagram of a gaming system according to one embodiment of the present invention.

As depicted in FIG. 1, according to one embodiment of the invention, each gaming terminal 102*a*, 102*b*, 102*c* is coupled via communication links 104*a*, 104*b*, 104*c* to a central computer 106. A number of types of gaming terminals can be used. In the depicted embodiment, each gaming terminal has a microprocessor 108 coupled to a memory 110, a display or other output device 112, and a communications facility 114. The terminal 102 also includes a device for permitting the user to use or activate the device such as by placing a wager, using coin slot 118 or other activation device such as a credit card slot, a bill verifier, a smart card receiving slot, a keyboard for receiving an identifier code, one or more buttons by which a user may initiate and/or control play which, if desired, may include touch screen ("virtual") buttons, e.g. presented on the display screen 112, and/or a slot machine-style lever (not shown). The microprocessor 108 operates in accordance with a program 122 stored in memory 110 (or stored in a separate memory such as an EEPROM or flash memory).

Although it is possible to provide for all terminals which are coupled to the central computer 106 to be configured to play the same type of game, preferably, the terminals 102*a*, 102*b*, 102*c* and the programs 122 therein, are configured so that different terminals may be used for playing different types of games, e.g. such that some terminals may be used for playing a slot machine-style game, others may be used for playing a poker-style game, others may be used for playing a keno-style game, and the like. In one embodiment, some or all terminals may be configured so that they may be used for playing any of a plurality of different games, as selected by casino personnel and/or as selected by the user. Although players may subjectively consider that some or all game play on a given gaming terminal represents the same game, in at least some situations, embodiment of the present invention are implemented on the basis that game play which differs in the number of coins wagered and/or (in the example of a slot machine) the number or placement of pay lines can be considered as being different games, e.g. in the sense of having a different pay table and/or receiving random number seeds drawn from a different pool (in a non-banked game).

In the depicted embodiment, the memory 110 of each terminal 102 stores pay table information, i.e. information which determines, for a given game result, whether that result represents a winning result or a losing result and, if a winning result, the type and/or amount of the payout for such win. The general manner of constructing a program to control a microprocessor so as to permit a user to play various games and output results is well-known in the art nad the manner of constructing the program to further implement the present invention will be understood by those of skill in the programming art after understanding the present disclosure.

The communications device 114 can be any of a plurality of devices known to those of skill in the art for receiving data communications and placing it in a format suitable for transmission to the microprocessor 108. In one embodiment, as described below, communication between the terminals 102 and the central computer 106 is two-way communication so that hte communications device 114 also acts to transmit request and status information from the microprocessor 108 to the central computer 106.

The communications links 104 can be of various types, including coaxial cable, telephone cable, optical fiber, microwave communication links, infrared communication links, and the like. In one embodiment, a second computer 124 is coupled to the communication links 104*a*, 104*b*, 104*c* for monitoring the communications, e.g. for bookkeeping and/or security purposes, which may be a computer specification to a particular casino or other geographic location or a subdivision thereof.

In one embodiment of this invention the central computer 106 outputs to an individual gaming terminal 102 (in response to a request for a game play seed from that terminal for a particular game type (sent over the communications link 104), a random number generator seed that is utilized to produce all required random numbers for a game play. In one embodiment, the request includes the terminal's address. In one embodiment the seed request, output by the terminal, includes an identification, identifying (alone, or in combination with the terminal address) the type of terminal and/or type of game (e.g. 3-nickel slot, $2.00 draw poker and the like). If the game type is "slot" then the terminal 102, using the provided seed, will cycle its random number generator the required number of times depending on the quantity of reels for that particular slot game. With a known starting seed, the terminal's internal random number generator will arrive at the correct reel stop position for all reels to produce the game play results as determined by the random number seed. This same general procedure can be used in other games such as the ball draw of a keno game and the card draw for poker-style games and the like, as will be clear to those of skill in the art after understanding the present disclosure.

It would be possible to provide several systems, each with a central random number generator and coupled terminals, e.g. with each system configured to play a different game, albeit at the cost of requiring more apparatus than might otherwise be needed.

In one embodiment one central computer 106 outputs a game outcome "seed", over communications link 104, in a message which is addressed to the requesting terminal. The seed is then used by the specifically addressed gaming terminal microprocessor 108 to generate random numbers which are appropriate for the particular game being playing at that terminal. Transmission of a game outcome seed (typically a random number generator seed) to a particular terminal, rather than transmitting the random numbers which could be directly used by the gaming terminals, is believed to reduce the computational load on the central computer (which may additionally have security, bookkeeping or other duties) and the load on the communications links, albeit at the cost of additional computing at the gaming terminals Preferably, the relationship between the game outcome seed and the generated random number is deterministic in the sense that if any terminal, or more than one terminal, configured for playing a certain game receives a specific seed value, the resulting random numbers generated will always be the same even though the microprocessors in different terminals operate independently from one another. Procedures for generating a random number in a particular numerical range from a given random number seed are well known to those of skill in the programming art. In one embodiment, the central system provides an associated identification tag for each seed that is transmitted, and the seed and tags (and preferably the address of the recipient terminal) are (possibly temporarily) stored (e.g. in an electronic disk memory), e.g. so that the seed can be identified and later traced back to check for, or analyze, instances of cheating, to validate particularly large prize wins or similar purposes.

Figure 2:
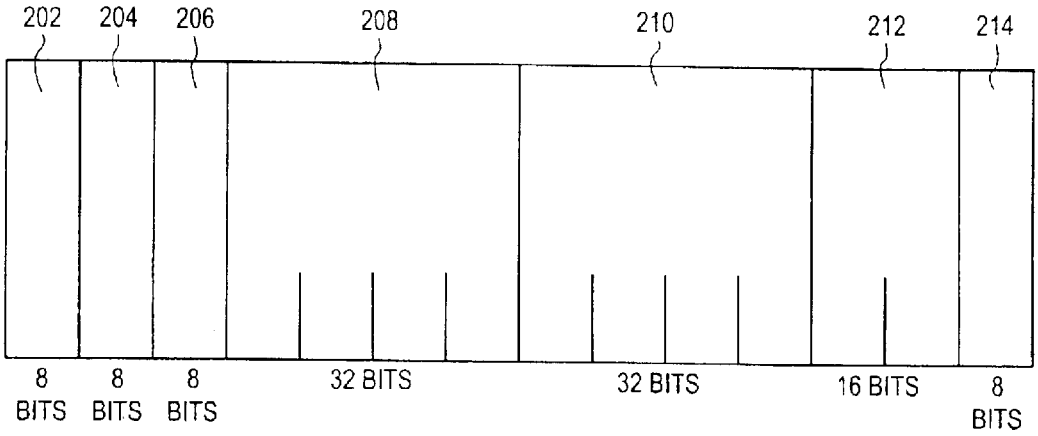
FIG. 2 depicts a format for transmitting a random number seed according to an embodiment of the present invention.

FIG. 2 depicts one format for transmitting a random number seed although other formats can be used, as will be apparent to those of skill in the art. The random number seed is embedded in a 112 bit-wide field. The first eight bits 202 signify an address with any address above 127 indicating a global address. The next eight bits 204 are a function code indicating what type of information this message contains. Preferably, at least one of the possible codes identifies this communications message as containing a random number seed. The next eight bits 206 indicate the game type code which the seed is for. The next thirty-two bits 208 are the random number seed. The next thirty-two bits 210 can indicate the seed identification tag number. The next sixteen bits 212 can indicate the game play win/loss results for verification purposes. The final eight bit field 214 is an error detection/correction field such as a cyclical redundancy check (CRC) field or parity field. In one embodiment, the data is encrypted by the central computer before transmitting over the links 104*a*, 104*b*, 104*c* and decrypted in the terminals 102 (and, optionally, the casino computer 124) according to decryption keys which may be downloaded, from time to time, or otherwise changed. Encryption assists in preventing cheating.

In one embodiment, the central computer may also be used for communicating information other than random number seeds. For example, the central computer may poll various gaming terminals or other devices to verify status, retrieve stored data, detect signs of cheating or other irregularities and the like. Although a polling system is described, it is also possible to use an interrupt system, as will be apparent to those of skill in the art.

In one embodiment, the central computer may be configured to detect cheating by receiving status verification data from gaming terminals. In one embodiment a gaming terminal, in response to a poll sends an electronic signature characteristic of its EEPROM or other component which the central computer can compare to the known correct or authorized signature stored in the central computer memory. In another embodiment, the central computer receives reports of wins or payouts from the various terminals. The central computer 106 can, if desired, keep a record of which random number seeds (and, if desired, associated identification tag) were distributed to which terminal and at which times and can, if desired, keep information necessary to replicate the operation of any connected terminal. If the central computer is drawing the random number seeds from a pre-constructed list of seeds, e.g. as would typically be done in a non-banked gaming system, then the seed identification tag 210 would indicate which entry from which list the random number seed represented.

Figure 3:
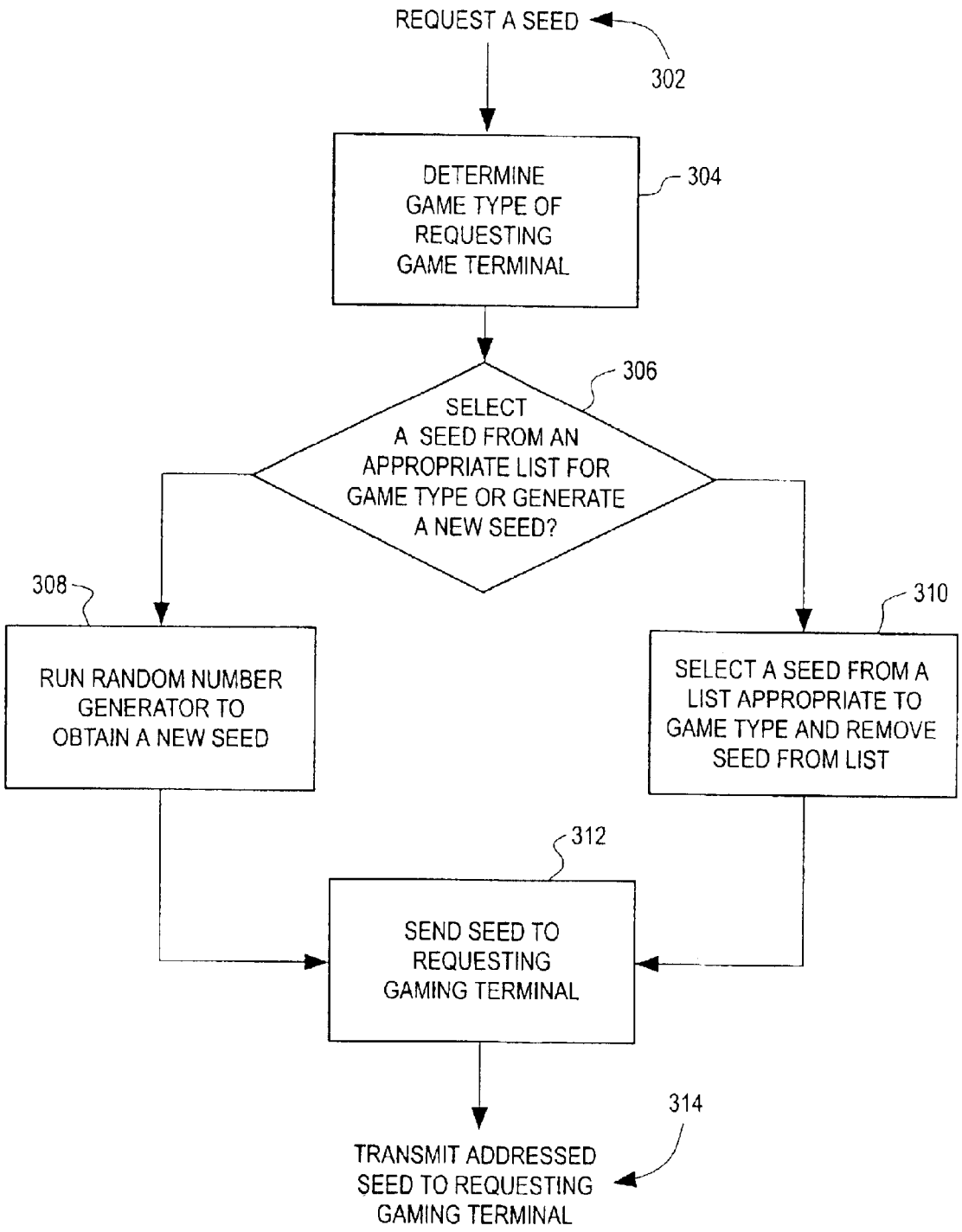
FIG. 3 is a flow chart of a process for generating or selecting, and sending a random number seed according to an embodiment of the present invention.

The embodiment depicted in FIG. 3 develops or selects seeds, within the central computer and upon request form gaming terminals 102. The process, in this embodiment, receives a random number seed request 301 from a gaming terminal via the communication link 104. Within the request message will preferably be a game type identification (e.g. utilized in logic 304 to determine what type of seed is requested). The logic in 306 will determine whether the requesting gaming terminal is banked or non-banked and will branch to appropriate other logic. If the game is banked, the central computer will run its internal random number generator 308 and create a random number seed for the requesting gaming terminal. If the game is non-banked then a seed will be removed 310 from a (predefined) list of seeds appropriate to a game type matching that of the request. A message is created 312 that contains the seed, requesting gaming terminal address, and seed identification tag. In one embodiment, e.g. for non-banked games, the win/loss outcome will be included (for verification purposes). The message is formatted 314 and delivered to the appropriate gaming terminal via the communication link 104.

Figure 4:
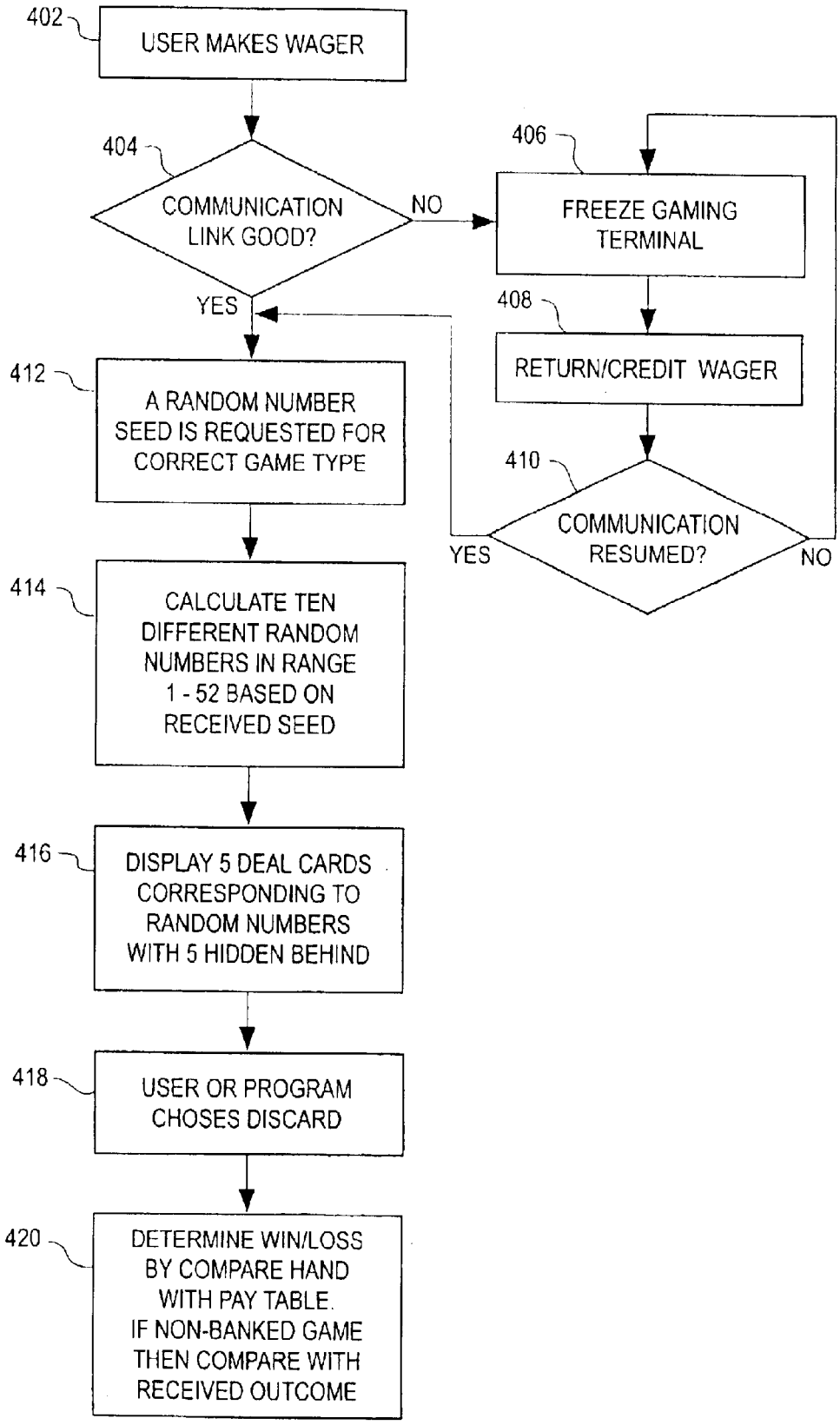
FIG. 4 is a flow chart for using a centrally generated random number seed received from a central computer for playing a poker game according to an embodiment of the present invention.

FIG. 4 depicts a manner of using a random number seeds in connection with the present invention, illustrated, in FIG. 4, in the context of a poker-type game. The procedure begins with activation of play in response to a user input 402 (such as a coin drop, a real or virtual button push, etc.). The gaming terminal microprocessor then determines 404 whether the communications link with the central computer appears to be currently active, e.g. whether any communications with the central computer has occurred within the last 1000 milliseconds. If the link appears to be lost, an appropriate "lost link" procedure will be implemented. Various options are available for this procedure. The microprocessor may freeze the operation of the terminal 406 preventing any further input or output, may, if desired, return money, or credit the account of the user 408 (or alternately may retain the wager), may notify the central computer and/or the casino, and/or may display a signal light, generate a sound, and the like. In one embodiment, the microprocessor continues to monitor for re-establishment of the link 410 (optionally within a predetermined time period) and, upon regaining the link, automatically continues play.

If it appears that the link is still good, the microprocessor requests 412, in a message to the central computer, a random number seed for a particular game type. Upon receipt of an appropriate seed form the central computer the microprocessor utilizes that seed as an input to its internal random number generator to generate, e.g. ten different random numbers 414 in the range of 1 through 52. The microprocessor then displays images of playing cards 416 which correspond to the first five random numbers that were generated. The microprocessor waits for a period of time to permit the user to select 418 which, if any, of the cards to discard, or in one embodiment of a non-banked game the gaming terminal-program will automatically determine which cards to discard. Following discard, the microprocessor will replace all discarded card images with one of the other five random numbers, following a predetermined order. The microprocessor then compares the final five card hand with a pay table to determine whether the hand is associated with a win or payoff 420.

In some jurisdictions, some or all games are required to remain in a non-banked status. In one embodiment, this is accomplished by selecting the prize amount values according to the current size of a player prize pool. Preferably the current size of that pool would be indicated in the random number seed message received by the microprocessor. The microprocessor would adjust prize values according to the player pool value received in the random number seed message (or in another message specifically for that purpose).

In another embodiment, the random number seed message also indicates which cards are to be discarded and the microprocessor operates in an auto play mode, with the decision as to which cards to hold and which cards to discard removed from the player (the decision being made by the microprocessor automatically). This ensures that a pre-known outcome will result.

Figure 5:
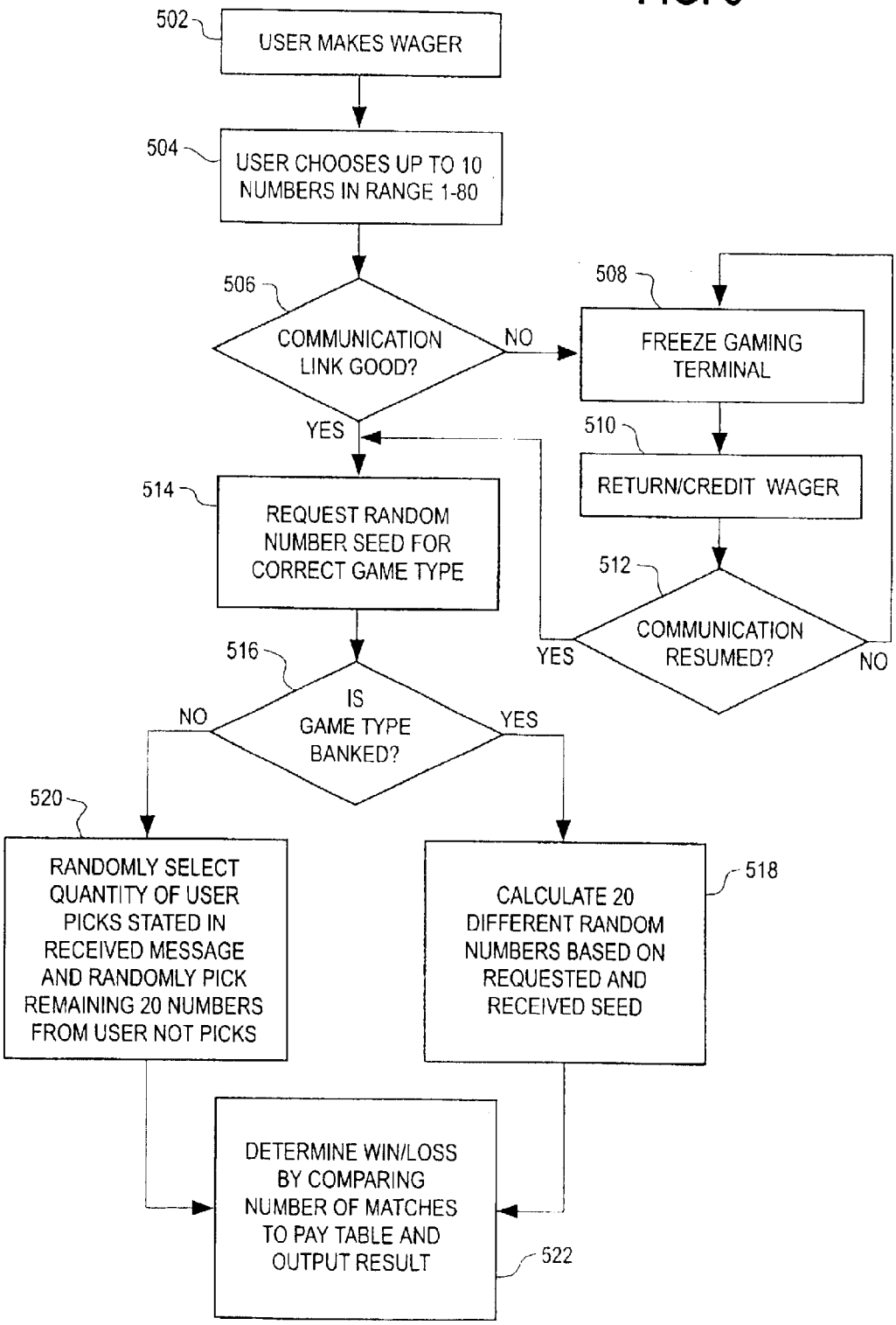
FIG. 5 is a flow chart for using the centrally generated random number seed for playing a keno game according to an embodiment of the present invention.

FIG. 5 is a flowchart similar in some respects, to the flowchart of FIG. 4 but showing a procedure for playing a keno-style game. In FIG. 5 after the user initiates play, e.g. by making a wager 502, and choosing up to ten numbers in the range 1–90 504, the microprocessor checks to see whether the communication link is good 506. If not, the microprocessor institutes a "lost link" procedure which may include, e.g. freezing the gaming terminal 508 (i.e. refusing to accept further user input or to provide normal gaming output). If the communication link is good (or if a lost link is recovered 512) the microprocessor requests 514, in a message to the central computer, a random number seed for a particular game type. Upon receipt of an appropriate seed from the central computer the microprocessor determines 516 whether the game type is banked or non-banked.

If the game is banked, then the microprocessor utilizes that seed as an input to its internal random number generator to generate twenty different random numbers 518 in the range of 1 through 80 and displays those selections.

If the game is non-banked, the microprocessor also received from the central computer a quantity of user picks that should match the draw. The microprocessor then 520, utilizing the received random number seed, picks a quantity of the user's selections equal to the match quantity found in the message from the central computer. Then the microprocessor generates the required different numbers, from the remaining 1–80 possible numbers, to complete the twenty number draw.

The microprocessor then determines wins and losses by comparing the number of matches between the user-selected numbers and the generated numbers to a pay table and outputs the results, e.g. by reporting to the central computer and/or casino computer, placing an appropriate indication on the display screen, crediting the user's account or smart card, outputting coins or other payout and the like 522.

When a non-banked keno game is desired (or required), in one embodiment, the prize amount values are selected according to the current size of a player prize pool. The current size of that pool would be indicated in the random number seed message received by the microprocessor. The microprocessor would adjust prize values according to the player pool value received in the random number seed message or in another message specifically for that purpose.

In one embodiment, the random number seed request message indicates how many numbers were selected by the user in the game type field of the request message and also the same message will indicate which numbers were selected. The random number seed provided by the central computer will insure that a pre-known outcome will result.

Figure 6:
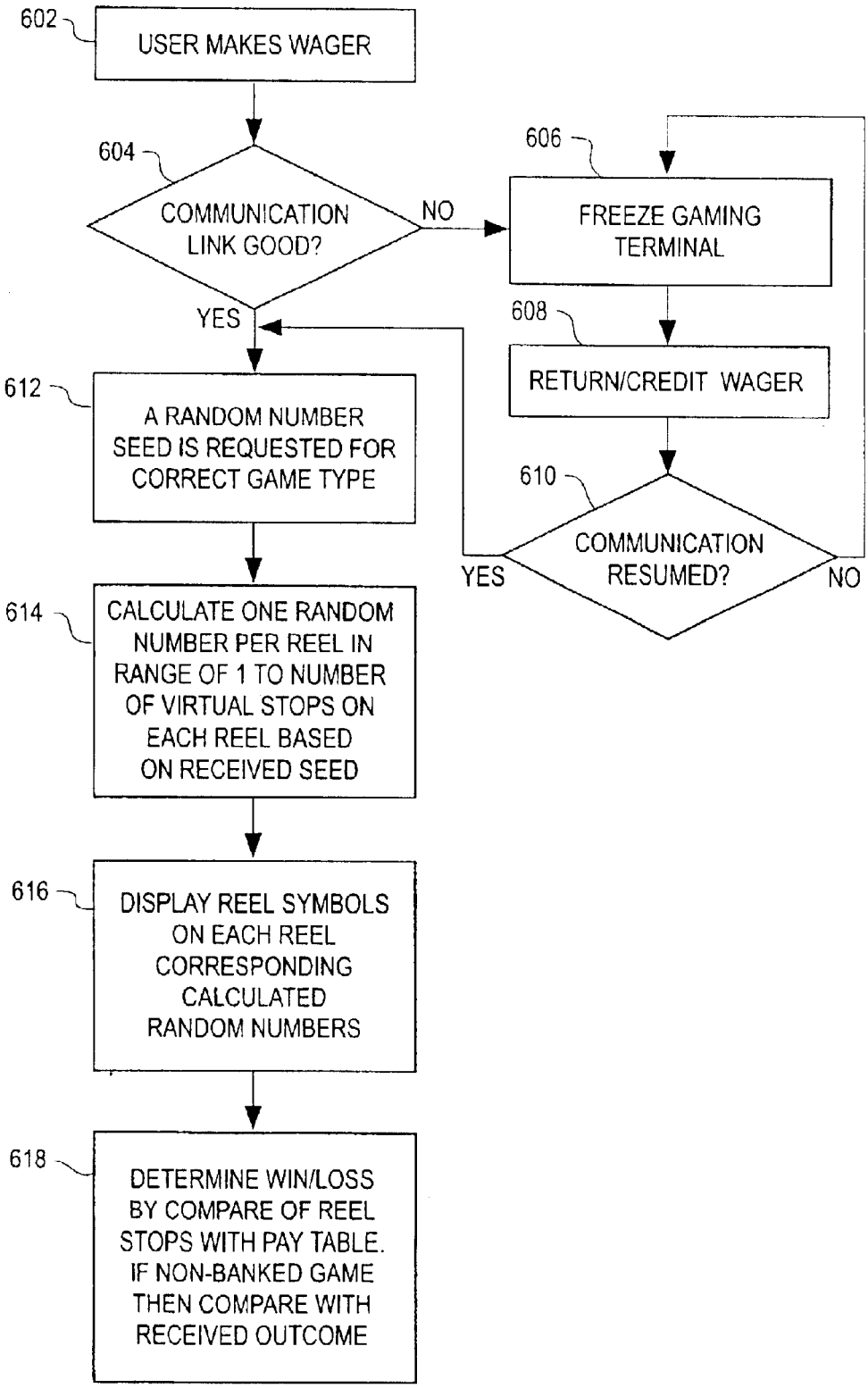
FIG. 6 is a flow chart of a process for using a centrally generated random number seed for playing a slot machine game according to an embodiment of the present invention.

FIG. 6 is a flowchart of a procedure similar to that depicted in FIG. 4 but used for playing a three reel slot type game. In the embodiment of FIG. 6 after the user makes a wager 602 such as by inserting a coin in a coin slot, pushing a real or virtual button, pulling a lever, and the like, the microprocessor determines whether the communication link is good 604. If not, the microprocessor institutes a "lost link" procedure which may include, e.g. freezing the gaming terminal 606 (i.e. refusing to accept further user input or to provide normal gaming output). If the communication link is good (or if a lost link is recovered 610) the microprocessor requests 612, in a message to the central computer, a random number seed for a particular game type. Upon receipt of an appropriate seed from the central computer the microprocessor utilities that seed as an input to its internal random number generator to calculate three random numbers 614 in the range of 1 through the maximum number of stops for each reel of this three reel slot-type game. If there are more than three reels in this slot-type game then more than three numbers will be generated. The microprocessor displays 616 the appropriate reel symbols based on the calculated random numbers. The microprocessor evaluates the calculated reel stops against its pay table to determine win/loss 618 and compares that value with the correct value provided in the random number seed message received from the central computer. If the evaluation is determined to be valid, the microprocessor then displays the results, such as by displaying a symbol associated with the stop position of each reel (or virtual reels in the case of a video slot machine) and outputs win/loss results 616. Other schemes for selecting reel stop positions using a random number will be apparent to those of skill in the art, after understanding the present disclosure.

In light of the above description, a number of advantages in the present invention can be seen. The invention provides for central generation of win/loss information for a plurality of gaming terminals, but still preserves entertainment value by providing the perception that selection of when and whether to play a particular terminal affects the outcome. Communication of the information is provided in such a way as to permit accounting, taking appropriate action when a communication link is lost, guarding against cheating, and providing a simple methodology for maintaining some or all games in a non-banked mode of operation when desired or required by jurisdictional regulation.

A number of variations and modifications in the invention can be used. It is possible to use some aspects of the invention without using others. For example, it is possible to provide individualized (e.g. individually addressed), centrally-generated random number seeds without providing for verification of gaming results. Although embodiments of the present invention were described using examples of certain types of games, the present invention can be implemented for playing a wide variety of different games and mixtures or combinations of games. Although it is contemplated that the present invention will be most useful in the context of casino style gaming, it is possible to provide embodiments of the present invention in a context of other types of gaming such as personal computer (PC) based gaming, internet gaming, arcade gaming and the like. In addition to, or in place of, sending game outcome information along with some or all winning seeds, it is possible to send "no win" indicators along with some or all non-winning games, such as a "no win" bit or other abbreviated indicia. Although embodiments have been described in the context of outputting a random number seed, the present invention can be used generally in the context of outputting any game outcome seed, i.e. any symbol, number, signal and the like which can be used by a gaming terminal for generating the game outcome.

The present invention, in various embodiments, includes components, methods, processes, systems and/or apparatus substantially as depicted and described herein, including various embodiments, subcombinations, and subsets thereof. Those of skill in the art will understand how to make and use the present invention after understanding the present disclosure. The present invention, in various embodiments, includes providing devices and processes in the absence of items not depicted and/or described herein or in various embodiments hereof, including in the absence of such items as may have been used in previous devices or processes, e.g. for improving performance, achieving ease and/or reducing cost of implementation. The present invention includes items which are novel, and terminology adapted from previous and/or analogous technologies, for convenience in describing novel items or processes, do not necessarily retain all aspects of conventional usage of such terminology.

The foregoing discussion of the invention has been presented for purposes of illustration and description. The foregoing is not intended to limit the invention to the form or forms disclosed herein. Although the description of the invention has included description of one or more embodiments and certain variations and modifications, other variations and modifications are within the scope of the invention, e.g. as may be within the skill and knowledge of those in the art, after understanding the present disclosure. It is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. A method for operating a gaming system comprising the steps of:

providing user picks from a terminal;

requesting random number seeds from a computer;

picking a quantity of the user picks;

generating required different outcomes from the user picks;

comparing the number of matches between the user picks and the random number seeds; and selecting outcomes according to a player prize pool provided by the random number seeds.

2. The method of claim 1 further comprising the steps of:

generating, in a first gaming terminal, the request for a first random number seed from the computer;

outputting the first random number seed from the computer addressed to the first gaming terminal;

generating, in a second gaming terminal, a request for a second random number seed from the computer;

outputting, from the computer the second random number seed addressed to the second gaming terminal;

generating, in the first gaming terminal, a first outcome; and generating in the second gaming terminal, a second outcome different from the first outcome.

3. The method of claim 2, wherein the first random number seed request includes a terminal address, a terminal type code and a game type code.

4. The method of claim 3, wherein the first random number seed includes a random number seed field that includes an address, a function code, game type code, a random number seed, a seed identification tag number, a game play win/loss result or an error detection/correction field.

5. The method of claim 4, wherein the random number seed field is embedded in a 112 bit-wide field.

6. A method of operating a gaming machine comprising the steps of:

requesting a random number seed from a computer;

initializing a random number sequence generator using the random number seed to generate an outcome;

using the outcome in order to determine game variables;

storing the game variables according to a player pool having a predetermined win/loss outcome; and providing the predetermined outcome according to a user pick made from the player pool.

7. The method of claim 6 further comprising the steps of:

coupling the computer to at least a first gaming terminal having a terminal processor configured for playing a game;

generating, in the first gaming terminal, the request for a first random number seed;

transmitting, from the computer, the first random number seed addressed to the first gaming terminal;

initiating play at the first gaming terminal by calculating a first random number in response to a user action occurring at a first time, wherein the first number is based on the first random number seed;

generating, in the first gaming terminal, a request for a second random number seed;

transmitting, from the computer, the second random number seed to the first gaming terminal; and initiating play at the first gaming terminal according to the game variables.

8. A method as claimed in claim 7, wherein the transmitting of at least the first random number seed is performed in response to the first random number seed request and the transmission including a terminal address, type of terminal or type of game.

9. A method as claimed in claim 7, wherein the first random number seed is specific to a game type of the first gaming terminal.

10. A method as claimed in claim 7, wherein the computer is coupled to a second game terminal and the method further includes the steps of:

generating, in the second gaming terminal, a request for a third random number seed;

transmitting, from the computer, the third random number seed addressed to the second gaming terminal; and initiating play at the second gaming terminal according to the game variables.

11. The method as claimed in claim 10, wherein the games of at least two of the plurality of gaming terminals are different.

12. A method as claimed in claim 10, wherein the step of transmitting at least the first random number seed includes transmitting over a communication link selected from among coaxial, telephone cable, fiber optics, microwave links, and infrared links.

13. A method as claimed in claim 12 wherein the communication link is used for transmitting a second type of information different from the random number seed.

14. A method as claimed in claim 10 further comprising detecting loss of a communication link between the central computer and the gaming terminal.

15. A method as claimed in claim 14 further comprising suspending game play in response to the step of detecting loss of a communication link.

16. Apparatus for using a gaming system comprising:

a central computer;

a plurality of gaming terminals means, each terminal means having a terminal processor means configured for playing a game;

means for coupling the central computer to the plurality of the gaming terminals in a non-banked mode of operation;

means for transmitting a first random number seed from the central computer to an addressed gaming terminal; and means, in the addressed gaming terminal, for initiating play by calculating a first random number based on the first random number seed requested and received in addition to a quantity of user picks to match the user action received at the addressed gaming terminal from the central computer substantially at the first time.

17. The apparatus as claimed in claim 16 further comprising:

means for transmitting a second random number seed from the central computer to the addressed gaming terminal;

means in the addressed gaming terminal for initiating play by calculating a second random number in response to a user action occurring at a second time, wherein the second random number is based on the second random number seed requested and received at the addressed gaming terminal from the central computer at substantially the second time.

18. The apparatus of claim 16, wherein the means for transmitting includes a processor in the central computer and a stored program.

19. The apparatus of claim 16, wherein the means for transmitting includes a processor and a stored program in the addressed gaming terminal.

20. The apparatus of claim 16, wherein during at least a first time period, a first gaming terminal receives a first random number seed and a second gaming terminal receives a second, different random number seed;

receiving a user input at the first gaming terminal at the first time period; and calculating a first random number at the first gaming terminal based on the received random number seed provided by the central computer so that game results of the first gaming terminal are substantially randomly selected from a predetermined pool of game outcomes.

21. The method of using a gaming system of claim 20 further including the steps of:

receiving a user input at the second gaming terminal at the first time period; and calculating a second, different random number at the second gaming terminal based on the received second random number seed provided by the central computer so that game results of the second gaming terminal are substantially randomly selected from a predetermined pool of game outcomes.

* * * * *